US005657990A

United States Patent [19]

Patel

[11] Patent Number: 5,657,990

[45] Date of Patent: Aug. 19, 1997

[54] BOARD GAME WITH FREELY MOVABLE PIECES

[76] Inventor: Vikeshkumar N. Patel, 135 Grove St., Roselle Park, N.J. 07204

[21] Appl. No.: 712,303

[22] Filed: Sep. 11, 1996

[51] Int. Cl.[6] ..... A63F 3/00

[52] U.S. Cl. ..... 273/263

[58] Field of Search ..... 273/258, 263, 273/260, 261, 255, 279

[56] References Cited

U.S. PATENT DOCUMENTS

| | | | |
|---|---|---|---|
| D. 24,701 | 9/1895 | Pierce | 273/258 X |
| 677,782 | 7/1901 | Lanz | 273/258 |
| 970,993 | 9/1910 | Colomb | 273/263 |
| 1,116,650 | 11/1914 | Waindle | 273/258 |
| 1,321,405 | 11/1919 | Suyehiro | 273/263 |
| 1,562,025 | 11/1925 | Killman | 273/263 |
| 2,896,950 | 7/1959 | Rosti et al. | 273/258 |
| 3,624,808 | 11/1971 | Anderson | 273/258 |
| 4,541,635 | 9/1985 | Shoptaugh | 273/258 X |
| 5,290,038 | 3/1994 | Khin | 273/263 |
| 5,306,015 | 4/1994 | Daud et al. | 273/263 |

FOREIGN PATENT DOCUMENTS

| | | | |
|---|---|---|---|
| 327703 | 12/1902 | France | 273/263 |
| 1168603 | 12/1958 | France | 273/263 |
| 2210802 | 6/1989 | United Kingdom | 273/258 |

*Primary Examiner*—William E. Stoll

[57] ABSTRACT

A board game with freely movable pieces comprised of a game board including a plurality of movement lines disposed thereon. The movement lines interconnect playing spaces. Sixteen playing pieces for a first player and sixteen playing pieces for a second player are included whereby the playing pieces for the first player are distinguishable from the playing pieces of the second player.

9 Claims, 3 Drawing Sheets

FIG 5
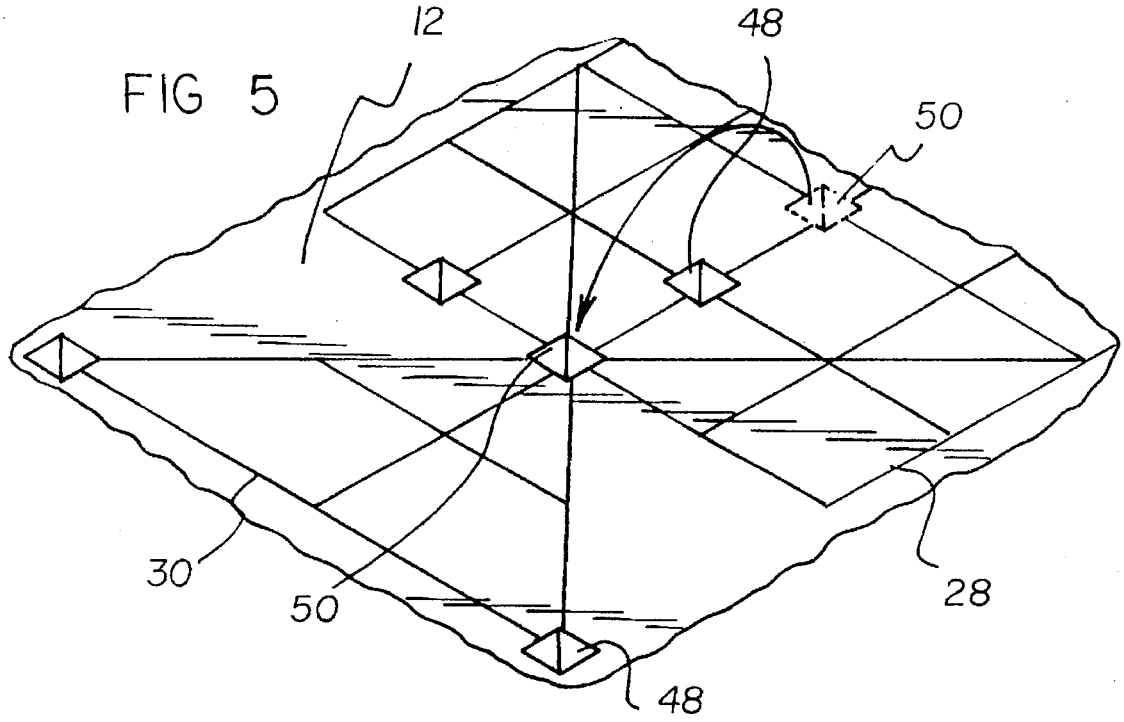
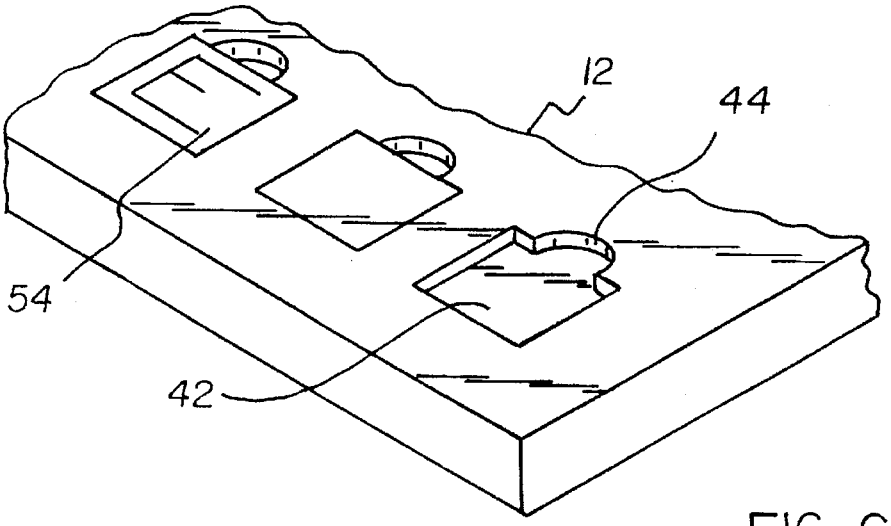
FIG 6

BOARD GAME WITH FREELY MOVABLE PIECES

BACKGROUND OF THE INVENTION

1. Field of the Invention

The present invention relates to a board game with freely movable pieces and more particularly pertains to moving pieces over a gameboard in order to capture opponents game pieces with a board game with freely movable pieces.

2. Description of the Prior Art

The use of game boards is known in the prior art. More specifically, game boards heretofore devised and utilized for the purpose of transposing pieces are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,403,012 to Stein discloses a board game with transposing pieces.

U.S. Pat. No. 5,405,147 to Garcia discloses a board for multiple games.

U.S. Pat. No. 5,409,235 to Ameri discloses a pyramid game.

U.S. Pat. No. Design 356,343 to Londono discloses the ornamental design for a pyramid math star game board.

U.S. Pat. No. 5,421,582 to Ritter discloses an expanded chess game and method therefor.

U.S. Pat. No. 5,338,040 to Cutler discloses a three-dimensional chess.

While these devices fulfill their respective, particular objective and requirements, the aforementioned patents do not describe a board game with freely movable pieces for moving pieces over a gameboard in order to capture opponents game pieces.

In this respect, the board game with freely movable pieces according to the present invention substantially departs from the conventional concepts and designs of the prior art, and in doing so provides an apparatus primarily developed for the purpose of moving pieces over a gameboard in order to capture opponents game pieces.

Therefore, it can be appreciated that there exists a continuing need for new and improved board game with freely movable pieces which can be used for moving pieces over a gameboard in order to capture opponents game pieces. In this regard, the present invention substantially fulfills this need.

SUMMARY OF THE INVENTION

In the view of the foregoing disadvantages inherent in the known types of game boards now present in the prior art, the present invention provides an improved board game with freely movable pieces. As such, the general purpose of the present invention, which will be described subsequently in greater detail, is to provide a new and improved board game with freely movable pieces and method which has all the advantages of the prior art and none of the disadvantages.

To attain this, the present invention essentially comprises a game board having a top surface and a lower surface. The game board is of a planar and rectangular configuration. The top surface includes a plurality of movement lines disposed thereon. The movement lines interconnect playing spaces. The plurality of movement lines include horizontal, vertical and diagonal movement lines. The plurality of movement lines are arranged into a rectangular center playing surface and a pair of triangular end playing surfaces. The rectangular center playing surface includes six horizontal rows and five vertical rows. Each triangular end playing surface includes an outer horizontal row of three widely positioned playing spaces, an intermediate horizontal row of three narrowly positioned spaces and an apex of one playing space. The apex of each triangular end playing surfaces intersects opposing end horizontal rows of the rectangular playing surface. The game board has recesses formed in opposing ends of the top surface thereof. Each recess is formed with a finger notch. The recesses are arranged in sets of nine and seven. The game includes sixteen playing pieces for a first player and sixteen playing pieces for a second player whereby the playing pieces for the first player are distinguishable from the playing pieces of the second player. The game includes two sets of lettered pieces. Each of the sets of lettered pieces are positionable within the recesses formed in the opposing ends of the game board. Each of the sets of lettered pieces are arrangable to spell out "PROFESSOR SIXTEEN".

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved board game with freely movable pieces which has all the advantages of the prior art game boards and none of the disadvantages.

It is another object of the present invention to provide a new and improved board game with freely movable pieces which may be easily and efficiently manufactured and marketed.

It is a further object of the present invention to provide a new and improved board game with freely movable pieces which is of durable and reliable construction.

An even further object of the present invention is to provide a new and improved board game with freely movable pieces which is susceptible of a low cost of manufacture with regard to both materials and labor, and which accordingly is then susceptible of low prices of sale to the consuming public, thereby making such a board game with freely movable pieces economically available to the buying public.

Even still another object of the present invention is to provide a new and improved board game with freely movable pieces for moving pieces over a gameboard in order to capture opponents game pieces.

Lastly, it is an object of the present invention to provide a new and improved board game with freely movable pieces comprised of a game board including a plurality of movement lines disposed thereon. The movement lines interconnect playing spaces. Sixteen playing pieces for a first player and sixteen playing pieces for a second player are included whereby the playing pieces for the first player are distinguishable from the playing pieces of the second player.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an example of the type of moves the game pieces can make.

FIG. 6 is a fragmentary view of the game board illustrating the letter slots formed therein.

The same reference numerals refer to the same parts through the various Figures.

DESCRIPTION OF THE PREFERRED EMBODIMENT

Figure 1:
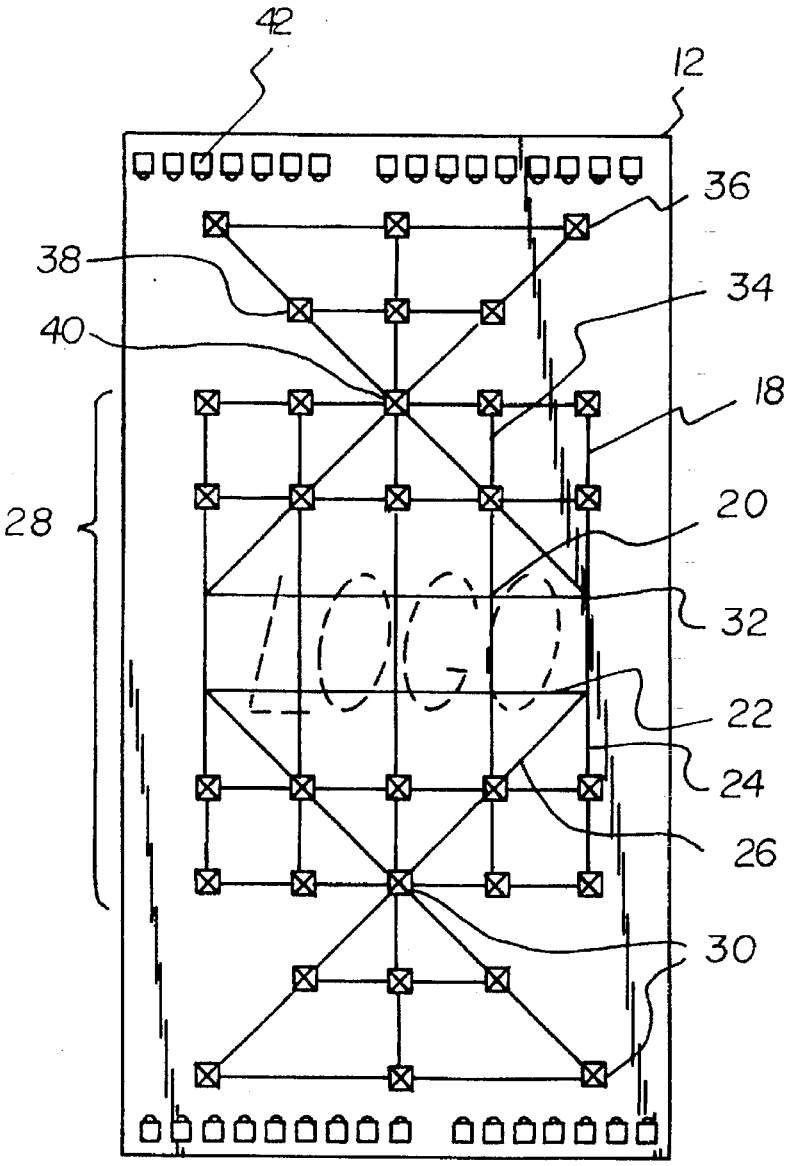
FIG. 1 is a perspective view of the preferred embodiment of the board game with freely movable pieces constructed in accordance with the principles of the present invention.

With reference now to the drawings, and in particular, to FIGS. 1–6 thereof, the preferred embodiment of the new and improved board game with freely movable pieces embodying the principles and concepts of the present invention and generally designated by the reference number 10 will be described.

Specifically, it will be noted in the various Figures that the device relates to a board game with freely movable pieces for moving pieces over a gameboard in order to capture opponents game pieces. In its broadest context, the game consists of a game board, playing pieces and two sets of lettered pieces. Such components are individually configured and correlated with respect to each other so as to attain the desired objective.

The game 10 includes a game board 12 having a top surface 14 and a lower surface 16. The game board 12 is of a planar and rectangular configuration. Note FIGS. 1 and 2. The top surface 14 includes a plurality of movement lines 18 disposed thereon. The movement lines 18 interconnect playing spaces 20. The plurality of movement lines 18 include horizontal 22, vertical 24 and diagonal 26 movement lines. The plurality of movement lines 18 are arranged into a rectangular center playing surface 28 and a pair of triangular end playing surfaces 30. The rectangular center playing surface 28 includes six horizontal rows 32 and five vertical rows 34. Each triangular end playing surface 30 includes an outer horizontal row 36 of three widely positioned playing spaces, an intermediate horizontal row 38 of three narrowly positioned spaces and an apex 40 of one playing space. The apex 40 of each triangular end playing surfaces 30 intersects opposing end horizontal rows of the rectangular playing surface 28. The game board 12 has recesses 42 formed in opposing ends of the top surface thereof. Each recess 42 is formed with a finger notch 44. Note FIG. 6. The recesses 42 are arranged in sets of nine and seven. Note FIG. 1.

Figure 2:
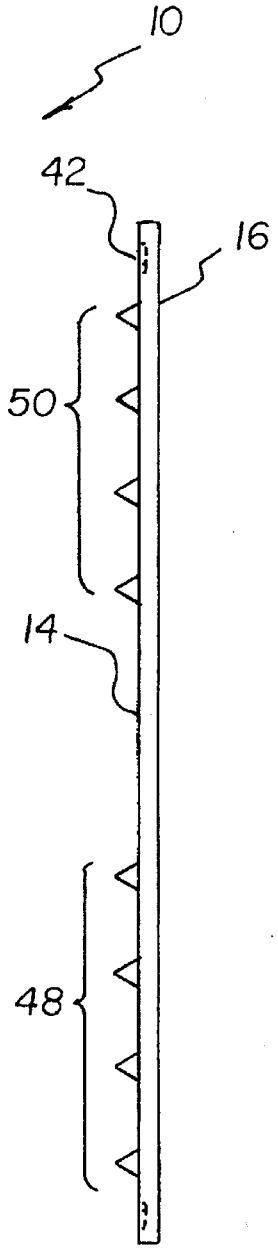
FIG. 2 is a side elevation view of the game board of the present invention.
Figure 3:
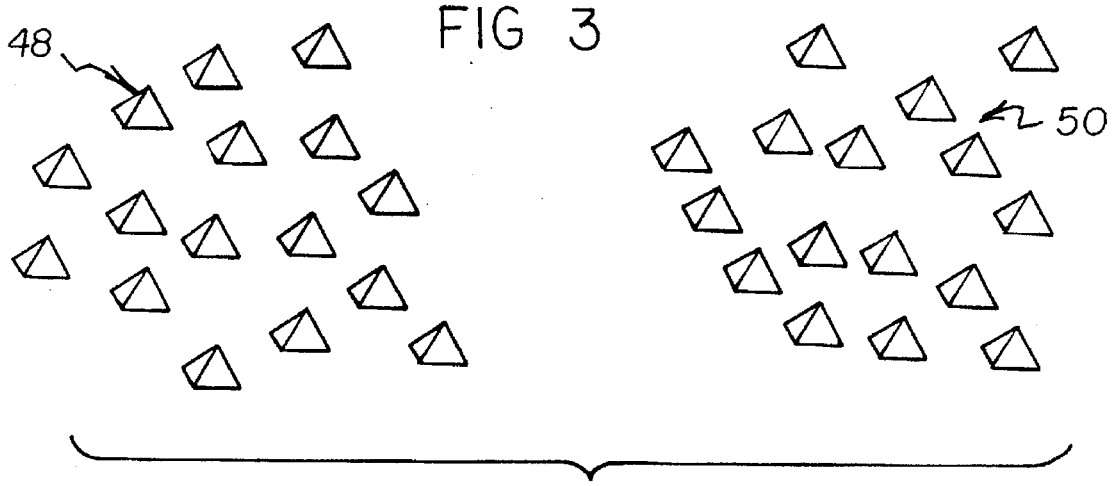
FIG. 3 is an isolated view of the game pieces of the present invention.
Figure 4:
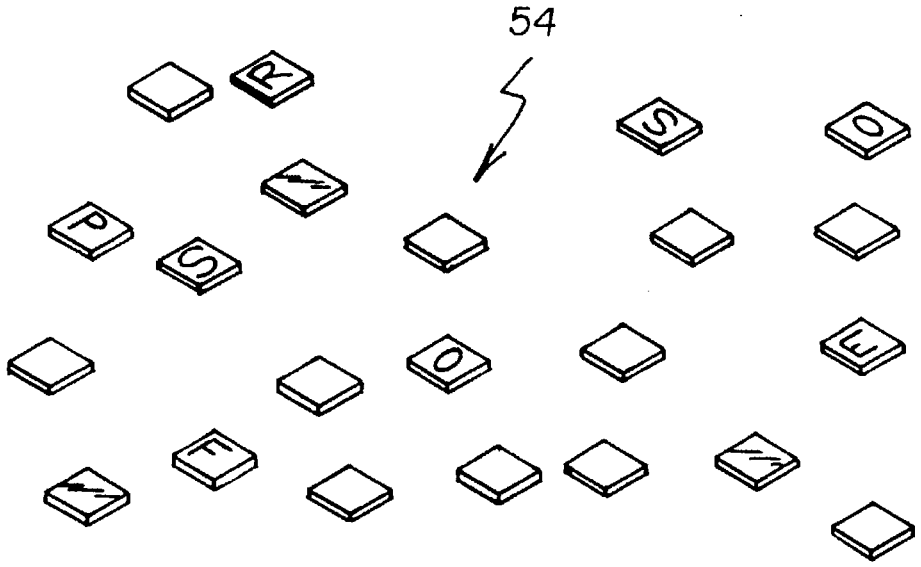
FIG. 4 is an isolated view of the lettered pieces of the present invention.

The game 10 includes sixteen playing pieces for a first player 48 and sixteen playing pieces for a second player 50 whereby the playing pieces for the first player 48 are distinguishable from the playing pieces of the second player 50. The playing pieces 48,50 are illustrated in FIG. 2 on the game board 12 and in FIG. 3. The playing pieces are formed in the shape of pyramids, but could be configured in any geometric shape as suggested in the art.

Lastly, the game 10 includes two sets of lettered pieces 54. Each of the sets of lettered pieces 54 are positionable within the recesses 42 formed in the opposing ends of the game board 12. Each of the sets of lettered pieces 54 are arrangable to spell out "PROFESSOR SIXTEEN".

The present invention is a strategic game in which players move pieces over a uniquely shaped game board 12 and attempt to capture their opponents playing pieces. To begin play, the players place their sixteen playing pieces 48,50 to fill their respective triangular end playing surfaces 30 and the lowermost two horizontal rows 32 of the rectangular playing surface 28. One playing piece is placed at each playing space 20. Players move one playing piece one playing space 20 per turn; except when an opposing playing piece can be jumped to an unoccupied space as illustrated in FIG. 5. In this case, the move may continue, to jump any more playing pieces left vulnerable along the movement lines 18. The playing pieces 48,50 can move forwards, backwards and diagonally at will. Each individual game is won by capturing all sixteen of your opponent's playing pieces; however, winning one game will not make you the winner. At the end of each game, the winner will receive a lettered piece 54 for each playing piece he/she has remaining. Once the player has enough letters to spell out "PROFESSOR SIXTEEN", he/she is then declared the winner. The toss of a coin will determine which player begins play.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A board game with freely movable pieces for moving pieces over a gameboard in order to capture opponents game pieces comprising, in combination:

a game board having a top surface and a lower surface, the game board being of a planar and rectangular configuration, the top surface including a plurality of movement lines disposed thereon, the movement lines interconnecting playing spaces, the plurality of movement lines including horizontal, vertical and diagonal movement lines, the plurality of movement lines being arranged into a rectangular central configuration and a pair of triangular end configurations, the rectangular central configuration including six horizontal rows and five vertical rows, each triangular end configuration including an outer horizontal row of three widely positioned playing spaces, an intermediate horizontal row of three narrowly positioned spaces and an apex of one playing space, the apex of each triangular end configuration intersecting opposing end horizontal rows of the rectangular central configuration, the game board having recesses formed in opposing ends of the top surface thereof, each recess being formed with a finger notch, the recesses being arranged in sets of nine and seven;

sixteen playing pieces for a first player and sixteen playing pieces for a second player whereby the playing pieces for the first player being distinguishable from the playing pieces of the second player; and two sets of lettered pieces, each of the sets of lettered pieces positionable within-the recesses formed in the opposing ends of the game board, each of the sets of lettered pieces arrangable to spell out "PROFESSOR SIXTEEN".

2. A board game comprising:

a game board including a plurality of movement lines disposed thereon, the movement lines interconnecting playing spaces, the game board having recesses formed in opposing ends of a top surface thereof, each recess being formed with a finger notch; and sixteen playing pieces for a first player and sixteen playing pieces for a second player whereby the playing pieces for the first player being distinguishable from the playing pieces of the second player.

3. The game board as set forth in claim 2 wherein the plurality of movement lines of the game board including horizontal, vertical and diagonal movement lines.

4. The game board as set forth in claim 3 wherein the plurality of movement lines being arranged into a rectangular central configuration and a pair of triangular end configurations.

5. The game board as set forth in claim 4 wherein the rectangular central configuration including six horizontal rows and five vertical rows.

6. The game board as set forth in claim 5 wherein each triangular end configuration including an outer horizontal row of three widely positioned playing spaces, an intermediate horizontal row of three narrowly positioned spaces and an apex of one playing space, the apex of each triangular end configuration intersecting opposing end horizontal rows of the rectangular configuration.

7. The game board as set forth in claim 2 wherein the recesses being arranged in sets of nine and seven.

8. The game board as set forth in claim 7 and further including two sets of lettered pieces, each of the sets of lettered pieces positionable within the recesses formed in the opposing ends of the game board.

9. The game board as set forth in claim 8 wherein each of the sets of lettered pieces arrangable to spell out "PROFESSOR SIXTEEN".

* * * * *